US007011178B2

(12) United States Patent
Morkerken

(10) Patent No.: US 7,011,178 B2
(45) Date of Patent: Mar. 14, 2006

(54) SOUND TRANSMITTER AND SPEAKER

(75) Inventor: Jean-Pierre Morkerken, 28 rue Labruyere, Paris (FR) 75009

(73) Assignees: Jean-Pierre Morkerken, Paris (FR); Universite Pierre et Marie Curie, Paris Cedex (FR)

( * ) Notice: Subject to any disclaimer, the term of this patent is extended or adjusted under 35 U.S.C. 154(b) by 5 days.

(21) Appl. No.: 10/476,252

(22) PCT Filed: May 14, 2002

(86) PCT No.: PCT/FR02/01612

§ 371 (c)(1),
(2), (4) Date: Oct. 30, 2003

(87) PCT Pub. No.: WO02/093978

PCT Pub. Date: Nov. 21, 2002

(65) Prior Publication Data

US 2004/0173402 A1 Sep. 9, 2004

(30) Foreign Application Priority Data

May 15, 2001 (FR) ..... 01/06379

(51) Int. Cl.
*H05K 5/02* (2006.01)
*G10K 11/172* (2006.01)
*H04R 1/22* (2006.01)

(52) U.S. Cl. ..... 181/151; 181/156; 181/144; 181/160; 181/199; 381/354; 381/338; 381/349; 381/353

(58) Field of Classification Search ..... 181/151, 181/156, 144, 146, 152, 153, 159, 160, 199, 181/155; 381/354, 338, 342, 345, 349, 353
See application file for complete search history.

(56) References Cited

U.S. PATENT DOCUMENTS

| | | | | | |
|---|---|---|---|---|---|
| 1,715,831 | A | * | 6/1929 | Hahnemann | 181/160 |
| 1,814,554 | A | * | 7/1931 | Hutchison | 181/160 |
| 3,486,578 | A | * | 12/1969 | Albarino | 381/350 |
| 3,978,941 | A | * | 9/1976 | Siebert | 181/151 |
| 4,135,600 | A | * | 1/1979 | Ogi et al. | 181/156 |
| 4,369,857 | A | * | 1/1983 | Frazer et al. | 181/159 |
| 4,733,749 | A | | 3/1988 | Newman et al. | 181/144 |
| 4,930,596 | A | * | 6/1990 | Saiki et al. | 181/152 |
| 5,109,422 | A | * | 4/1992 | Furukawa | 181/160 |
| 5,111,509 | A | * | 5/1992 | Takeuchi et al. | 181/160 |
| 5,173,575 | A | * | 12/1992 | Furukawa | 181/156 |
| 5,253,301 | A | * | 10/1993 | Sakamoto et al. | 381/349 |

(Continued)

FOREIGN PATENT DOCUMENTS

FR 664.330 2/1928

(Continued)

*Primary Examiner*—Edgardo San Martin
(74) *Attorney, Agent, or Firm*—Young & Thompson

(57) ABSTRACT

A sound transmitter includes at least a vibrating membrane mounted on the wall of an enclosure so that one surface of the speaker membrane radiates in the enclosure, the enclosure being provided with a vent forming a conduit between an outlet inside the enclosure and an outlet outside the enclosure. The vent comprises aerodynamic turbulence attenuating elements at least at one of the outlets, the turbulence resulting from an air stream caused by the large amplitude displacements of the membrane. The invention also concerns a sound transmitter wherein air moves in a conduit (33) extending from the membrane to an outlet (35) of the conduit (33) on the outside. The invention further concerns a speaker whereof the members have an aerodynamic shape.

10 Claims, 3 Drawing Sheets

U.S. PATENT DOCUMENTS

| | | | | | |
|---|---|---|---|---|---|
| 5,313,525 | A | * | 5/1994 | Klasco | 181/156 |
| 5,623,132 | A | | 4/1997 | Gahm | 181/156 |
| 5,714,721 | A | * | 2/1998 | Gawronski et al. | 181/156 |
| 5,892,183 | A | * | 4/1999 | Roozen et al. | 181/156 |
| 6,002,781 | A | * | 12/1999 | Takayama et al. | 381/345 |
| 6,084,971 | A | * | 7/2000 | McLean | 381/71.5 |
| 6,275,597 | B1 | * | 8/2001 | Roozen et al. | 181/156 |
| 6,684,977 | B1 | * | 2/2004 | Stuart | 181/199 |
| 6,771,787 | B1 | * | 8/2004 | Hoefler et al. | 381/338 |
| 6,798,891 | B1 | * | 9/2004 | Sadaie et al. | 381/354 |

FOREIGN PATENT DOCUMENTS

| | | | | |
|---|---|---|---|---|
| FR | 2664782 | A1 | * | 1/1992 |
| GB | 489588 | | | 7/1937 |
| GB | 2 324 928 | | | 11/1998 |
| JP | 05122785 | A | * | 5/1993 |
| JP | 05176384 | A | * | 7/1993 |
| JP | 05268686 | A | * | 10/1993 |
| WO | WO 90/11668 | | * | 10/1990 |

* cited by examiner

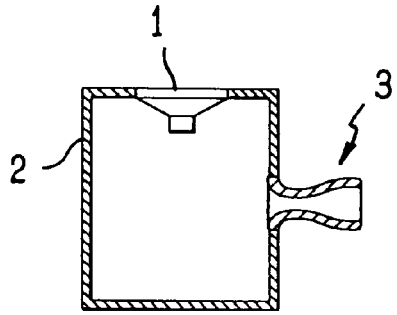
FIG.1
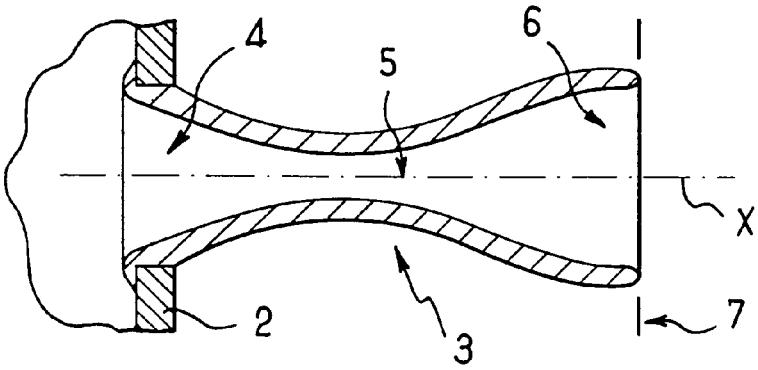
FIG.2
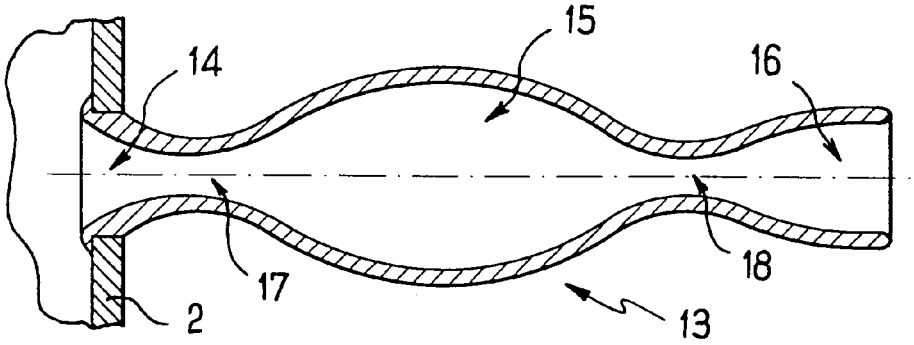
FIG.3
FIG.4
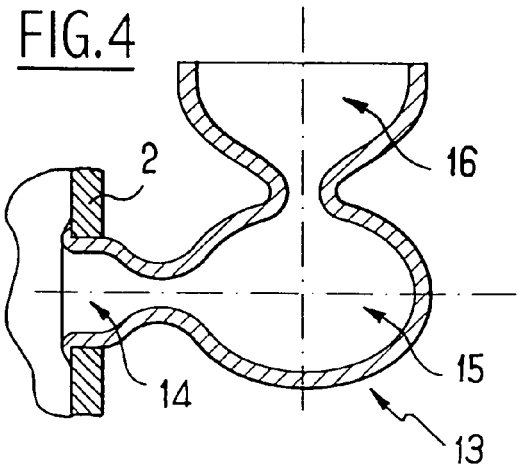
FIG.5
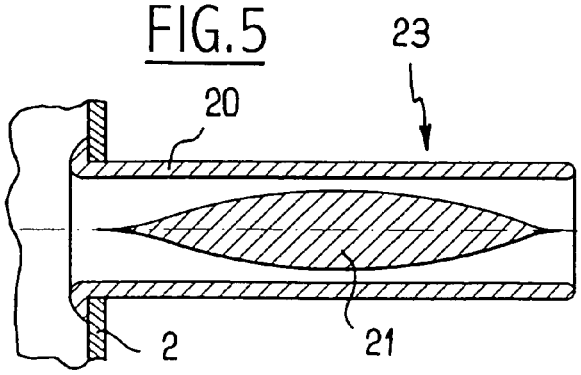

SOUND TRANSMITTER AND SPEAKER

CROSS REFERENCE TO RELATED APPLICATIONS

This is the 35 USC 371 National Stage of International Application PCT/FR02/01612 filed on 14 May 2002, which designated the United Sates of America.

FIELD OF THE INVENTION

The invention relates to a sound emitter of the type that converts an electrical signal into a sound signal, i.e. into a pressure wave radiating in the atmosphere.

BACKGROUND OF THE INVENTION

Emitters are known of the type comprising at least one loudspeaker mounted in the wall of a speaker enclosure with one face of the diaphragm radiating into the outside air and the other face radiating into the inside of the enclosure.

The enclosure is generally provided with a vent putting the inside of the enclosure into communication with the outside, and enabling pressure waves generated by the diaphragm and radiating into the enclosure to be radiated outwards.

The vent forms the orifice of a Helmholtz resonator whose cavity is constituted by the enclosure. In application of a well-known property of that type of resonator, the pressure wave radiated at the outlet of the vent is in phase opposition to the pressure wave radiated into the enclosure by the diaphragm. The pressure wave radiated at the vent outlet is thus in-phase with the pressure wave radiated by the face of the diaphragm that faces towards the outside of the enclosure, such that the effects of the two pressure waves add and increase the power played-back sound.

It is known that such a resonator possesses a characteristic frequency representing a lower limit for the frequency of sounds that can be transmitted by the resonator. This characteristic frequency varies directly as a function of the section of the vent and inversely as a function of the volume of the enclosure and of the length of the vent.

In order to lower the characteristic frequency of the resonator and thus enable it to transmit sounds at very low frequency, it is necessary either to increase the volume of the enclosure, which then becomes bulky, or else to increase the length of the vent, which makes it difficult to position within the enclosure, or even to reduce the section of the vent. However, when the section is reduced, it is found that the sound power of the emitter decreases.

OBJECTS AND SUMMARY OF THE INVENTION

An object of the invention is to propose a sound emitter having better efficiency than known sound emitters, particularly at low frequencies.

To this end, the invention provides a sound emitter comprising at least one loudspeaker provided with a vibrating diaphragm and mounted in the wall of an enclosure so that one face of the loudspeaker diaphragm radiates into the enclosure, the enclosure being provided with a vent forming a duct between an opening inside the enclosure and an opening outside the enclosure, the vent including, according to the invention, means for attenuating aerodynamic turbulence in at least one of its openings, said turbulence being the result of air flowing in the vent due to large-amplitude displacements of the diaphragm.

The term "large amplitude" is used to designate displacement of the diaphragm which is sufficient to cause air to be displaced in the vent in a manner that is not negligible relative to the dimensions of the vent.

Under such conditions, and in the absence the adaptations provided by the invention, the outlet flow through the vent openings is essentially turbulent, thereby firstly pointlessly dissipating energy, and secondly decreasing the efficiency of the sound emitter.

The vent of the invention makes it possible to minimize the production of turbulence at the openings, so that the efficiency of the sound emitter is improved.

It has thus been found that the vent of the invention makes it possible to achieve a spectacular improvement in the playback of sound at low frequency, even making it possible, contrary to that which is usually found in acoustics, to obtain excellent efficiency at frequencies that are lower than the characteristic frequency of the Helmholtz resonator formed by the enclosure and the vent.

Careful analysis of this phenomenon has led the inventor to suggest the hypothesis whereby the pressure wave obtained at the outlet from the vent under such conditions is no longer a wave as obtained in conventional manner, i.e. by setting into vibration the spring formed by the air inside the enclosure and the mass formed by the air in the vent. At low frequencies, the air inside the resonator behaves rather like an incompressible fluid. It then appears that the pressure wave generated by an emitter of the invention is the result of macroscopic displacement of quasi-incompressible air inside the vent, which creates radiation in the outside air.

The adaptation of vent shapes in accordance with the invention has thus revealed a novel mode for creating soundwaves that does not depend on the elasticity of air, this novel mode being particularly suitable for transmitting low frequencies. This phenomenon is referred to below as "convective radiation".

The means for attenuating turbulence are advantageously constituted by internal shapes of the duct and/or of the openings, arranged to allow air to flow in regular manner in the vent.

The term "regular" is used to mean that the flow tends towards a flow of the one-dimensional type within the outlet section of the flow. Care is taken to make this flow as laminar as possible, by providing flow sections that vary smoothly, without any sudden changes.

In a preferred version of the invention, at least one of the openings is of a shape that flares towards its end.

Thus, for a flow going from the inside of the enclosure towards the outside, the inside opening presents a converging shape which enables the speed of the air inside the enclosure in the vicinity of the vent to be raised progressively so as to enable it to flow therein in regular manner without forming turbulence, and thus minimizing energy losses.

In the same flow direction, a flaring outside opening serves to slow down the air escaping from the vent, and thus to decrease outlet turbulence. It is thus possible to throttle the duct so as to lower the characteristic frequency of the resonator, while providing the pressure wave with a significant radiating surface area at the outlet, with said area not being limited to the section of the duct.

For a given characteristic frequency, this throttling makes it possible to give the volume of the enclosure dimensions that are much more compact than those of present sound emitters.

Furthermore, in accordance with a phenomenon that is well known in fluid mechanics, the slowing down of the air that is obtained by the diverging shape of the outside opening enables the corresponding variation in the kinetic energy of the air to be transformed into additional pressure. Thus, kinetic energy, which is of no utility acoustically speaking, is transformed into pressure which does have an acoustic effect, thereby enabling the efficiency of the sound emitter to be further improved.

Throughout this document, the terms "inside" and "outside" are relative to the enclosure, whereas the terms "converging" and "diverging" are relative to air flowing from the inside towards the outside of the enclosure, it being understood that air flows alternately in one direction and then in the other at the rate of the alternating displacements of the diaphragm.

In an advantageous aspect of the invention, the section profile of the flaring opening presents a terminal concave portion facing towards the inside of the opening.

Thus, the opening forms a nozzle channeling outlet air flow, without air streams separating from the wall of the opening.

In a particular arrangement, the vent is fitted with a plenum chamber between its inside and outside openings.

This chamber serves to further reduce turbulence in the flow, and thus to further improve the efficiency of the sound emitter.

According to an advantageous aspect, the plenum chamber forms an angled bend between the inside opening and the outside opening. This disposition enables a compact vent to be provided.

At least one of the openings preferably has a diameter that is adapted to make the flow of air laminar in the opening.

In order to take best advantage of these recently-discovered phenomena, the inventor has come to the conclusion that instead of seeking to channel the flow solely in the vent, it is much more profitable to channel the flow from the immediate vicinity of the diaphragm.

Consequently, the invention also provides a novel type of sound emitter comprising at least one vibrating diaphragm mounted in a body having a duct in communication with the outside via a terminal portion and into which one face of the diaphragm radiates, the duct having means for attenuating aerodynamic turbulence in the terminal portion when air flows inside the duct due to large-amplitude displacements of the diaphragm.

Thus, contrary to the universally employed practices in the field of acoustics, the invention seeks not only to create pressure waves by acting on the elasticity of air inside the body, but also to guide a flow of air that has been set into outward motion by the diaphragm, so that it flows with as little turbulence as possible thus acting as a piston at the outlet from the body and creating a pressure wave in ambient air under the effect of macroscopic displacement of said air piston, implementing the convective radiation phenomenon.

The means for attenuating turbulence are preferably constituted by the internal shapes of the duct, these shapes being arranged to enable the air to flow regularly inside the duct.

In a first variant embodiment, the duct possesses a flared terminal portion.

This diverging portion acts as explained above so that the vent transforms into pressure at least a fraction of the kinetic energy of the air set into motion by the diaphragm.

In a preferred disposition, the sound emitter comprises two loudspeakers each having a vibrating diaphragm, and mounted in a body in such a manner that the diaphragms face each other and are electrically connected in phase opposition, the facing faces of the diaphragms radiating into the internal duct.

The effects of the diaphragms are cumulative on the displacement of air within the duct. For given air displacement and thus for given sound power, the displacement required of the diaphragms is reduced, thus making it possible to push back the power threshold beyond which the diaphragms or the associated moving members come into abutment.

The inventor has found that present loudspeakers are of a shape that is poorly adapted to allow air to flow in laminar manner, particularly on the side of the diaphragm that co-operates with the motor.

Thus, in order to achieve better control over the air flows generated by the vibrating diaphragm, the invention also provides a loudspeaker comprising a vibrating diaphragm mounted on a support and actuated by a motor connected to the support, the motor and the support having aerodynamic shapes adapted to give rise to as little turbulence as possible in the flow generated by the displacement of the diaphragm in the air in which the motor and the support are immersed.

Finally, the invention provides a method of producing sound, consisting in causing alternating and convective displacement of the air contained in a duct possessing an outside outlet, and in transforming at least portion of the kinetic energy thus communicated to the air into pressure at the outlet from the duct.

The term "convective displacement" is used to mean displacement of all of the air through an amplitude that is not negligible relative to the dimensions of the duct. The term "alternating" is used to mean displacement in one direction and in the opposite direction, at the rate that is imposed by the member that is causing the displacement of the air.

BRIEF DESCRIPTION OF THE DRAWINGS

Other characteristics and advantages of the invention appear more clearly in the light of the following description of particular, non-limiting embodiments of the invention given with reference to the accompanying figures, in which:

FIG. 1 is a section view of a sound emitter of the invention;

FIG. 2 is a fragmentary view on a larger scale than FIG. 1 showing a vent fitted to the sound emitter of the invention;

FIG. 3 is a view analogous to FIG. 2 showing a second embodiment of the invention;

FIG. 4 is a view analogous to FIG. 2 showing a variant of the embodiment shown in FIG. 3;

FIG. 5 is a view analogous to FIG. 2 showing a third embodiment of the invention;

DETAILED DESCRIPTION OF THE INVENTION

Figure 6:
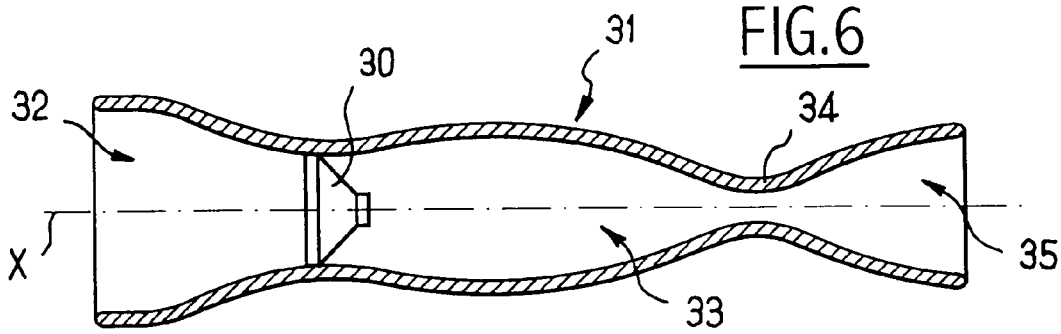
FIG. 6 is an axial section view of a sound emitter of the invention.

With reference to FIGS. 1 and 2, a sound emitter of the invention comprises in conventional manner a loudspeaker 1, in this case of the electrodynamic type having a vibrating diaphragm mounted in the wall of an enclosure 2 so that one face of the diaphragm radiates to the outside while another face radiates to the inside of the enclosure 2. The enclosure has a vent 3 of tubular shape about an axis X, the vent comprising an opening 4 to the inside of the enclosure 2, a duct 5 constituted in this case merely by a throat or constriction or throttling portion, and an opening 6 to the outside of the enclosure 2.

The inside opening 4 forms a converging collector guiding air from the enclosure 2 that is being forced to escape therefrom because of the diaphragm of the loudspeaker 1 moving towards the inside of the enclosure 2. The duct 5 forms a throat restricting the flow section through the vent 3 and acting as the orifice of a Helmholtz resonator whose cavity is formed by the enclosure 2. The outside opening 6 constitutes a diverging diffuser.

The sound emitter operates as follows.

For sound at medium or high frequency, pressure waves are generated essentially because of the compressibility of the air inside the enclosure. The displacement of air inside the vent 3 is insignificant compared with the inside dimensions of the vent 3. The assembly behaves like a conventional resonator.

At power levels that lead to large displacements of the diaphragm, the pressure inside the enclosure varies to a large extent and the air is then subjected to displacements within the vent 3 that are no longer negligible relative to the dimensions of the vent 3.

The inside shapes of the vent 3 enable the air to be set into motion so as to flow in regular and substantially one-dimensional manner. The air is initially brought up to speed by the inside opening 4 and then passes through the central duct 5 as a regular flow, after which it is channeled as a jet towards the outside by the outside opening 6.

The regular flow achieved in this way serves firstly to minimize energy losses in the form of turbulence and internal friction. It also serves to avoid excessive turbulence on leaving the outside opening 6, where such turbulence is responsible in conventional vents for a background noise that degrades sound playback. It can thus be seen that the presence of a vent 3 in accordance with the invention has a regularizing effect over the entire operating frequency range of the sound emitter, thereby improving the overall efficiency of the sound emitter.

In this respect, the inside shapes of the vent 3 follow a profile that varies slowly, the wall of the vent 3 being as free as possible from any sudden changes that might give rise to turbulence. The inlet edges of the openings are given rounded profiles in order to avoid whistle effects.

In a remarkable aspect of the invention, the outside opening 6 is of diverging shape. This shape serves to slow down the air leaving the vent 3 in accordance with the principle of conservation of flow, and thus serves to decrease jet turbulence in the outside. This characteristic makes it possible to reduce the diameter of the duct 5 so as to tune the Helmholtz resonator to very low frequencies, while nevertheless ensuring that the outward flow of air takes place at low speed and while retaining an enclosure whose volume is of reasonable dimensions. The outlet section area of the outside opening 6 can thus be more than half the area of the diaphragm of the loudspeaker 2, whereas the diameter of the duct 5 can be decreased to a considerable extent.

The diverging shape also makes it possible to convert into pressure the kinetic energy that is lost due to the air slowing down. This characteristic is particularly advantageous when emitting low frequency sounds where it is known that a large fraction of the energy delivered to the loudspeaker diaphragm is transformed into kinetic energy for the air as a whole inside the vent. Unfortunately, such kinetic energy does not contribute in any way to acoustic phenomena. By means of this conversion, a portion of the kinetic energy of the air is thus recovered and converted into pressure, which does contribute to acoustic phenomena.

In remarkable manner, the outside opening 6 has an end portion of concave profile, with its concave side facing towards the inside of the opening. The opening thus acts as a diffuser or a nozzle, channeling the air without any sudden separation of the air stream from the wall on leaving the vent.

It may be observed that the exponential horns sometimes used to match impedance at the outlet from a loudspeaker do not enable this conversion to be performed. Horns of that type have a convex profile that is unsuitable for ensuring that flow takes place in one-dimensional laminar manner. At the high flow speeds that are obtained at low frequencies and at large amplitudes, air separates prematurely from the surface of the horn and moves away turbulently. Acoustic efficiency collapses.

It has been found that the vent 3 of the invention enables sound efficiency to be significantly improved for all frequencies beyond the characteristic frequency of the Helmholtz resonator. In spectacular manner, the vent also makes it possible to obtain sound transmission with excellent efficiency at frequencies below the characteristic frequency of the resonator. This effect would appear to be explained by convective radiation, as mentioned in the introductory portion of this application.

FIG. 3 relates to a second embodiment of the invention, in which the sound emitter is fitted with a vent having a plenum chamber.

The vent 13 has a converging inside opening 14 and a diverging outside opening 16. A plenum chamber 15 is placed between the openings 14 and 16 and communicates with the inside opening 14 via a throat 17, and with the outside opening via a throat 18.

The plenum chamber 15 serves firstly to regularize the flow of air by slowing it down after it has passed through the throat 17, thereby damping any turbulence that might appear upstream from the throat 17. The air is accelerated again on leaving the plenum chamber 15 via the throat 18 and is slowed down again by the diverging outside opening 16. Depending on the dimensions of the plenum chamber 15, air can be caused to slow down therein to a greater or lesser extent.

The plenum chamber 15 together with the throat 18 also forms a second Helmholtz resonator in series with the first resonator formed by the enclosure 2 and the throat 17. It is known that a resonator of this type has the property of inverting the phase of the pressure wave relative to the motion of the diaphragm of the loudspeaker 1. The second resonator enables this phase to be inverted a second time so as to cause the pressure wave to be in-phase with the motion of the diaphragm.

The second resonator radiates not only outwards via the throat 18, but also towards the inside of the enclosure 2 via the throat 17. This reflected radiation has the property of regulating the motion of the diaphragm of the loudspeaker 1, thus making it possible to raise the power threshold at which the moving members of the loudspeaker come into abutment, and this is particularly advantageous at low frequencies. The plenum chamber 15 acts as a kind of stiffener for the diaphragm.

Any variation can be applied to the sound emitter as described above without going beyond the ambit determined by the claims.

In particular, although the description relates essentially to the flow of air from inside the enclosure towards the outside corresponding to the diaphragm moving towards the inside of the enclosure, it is manifest that for a movement of the diaphragm towards the outside of the enclosure, the flow will take place from the outside towards the inside of the enclosure. Under such circumstances, the inside opening of the vent acts as the outside opening, and vice versa. The vents are preferably made to be symmetrical in shape between their upstream and downstream ends, although non-symmetrical shapes made in accordance with the invention also work.

Although the description above relates to a tubular vent having a mean axis that is rectilinear, it is also possible to make use of vents having a mean axis that is curved, providing the curvature is sufficiently gentle to guarantee that flow is as laminar as possible.

If, for reasons of lack of space, it is necessary to make a vent that is clearly bent, it is preferable to use a vent with a plenum chamber having upstream and downstream portions extending therefrom in arbitrary directions. As shown in FIG. 4 by way of example, the upstream and downstream portions 14 and 16 extend from the plenum chamber 15 in directions that are substantially mutually normal. The plenum chamber is thus used as a damper enabling an angled bend to be achieved while minimizing aerodynamic losses.

Although the vent has been shown as being located essentially outside the enclosure, the invention also applies to a vent that is placed essentially inside the enclosure.

Although the vent is shown as being tubular in shape, the invention also applies to a vent of annular section that varies, as shown in FIG. 5 where the vent 23 comprises a tubular outside portion 21 and an inside core 22 connected to the outside portion by link means (not shown) and defining an annular channel for air flow.

In the embodiment shown with reference to FIGS. 1 to 5, care is preferably taken to ensure that the flow is laminar, at least at the openings, with this applying even for large-amplitude displacement of the diaphragm. For this purpose, the diameter of the outlet section of an opening should be made as large as possible in order to obtain such laminar flow.

In another aspect of the invention, air flow is controlled not only in the vent, but also inside the enclosure.

With reference to FIG. 6, a sound emitter of the invention comprises a loudspeaker 30 placed in a body 31, the body 31 having inside shapes suitable for conveying in laminar manner a flow of air generated by the motion of the diaphragm of the loudspeaker 30.

On one side of the diaphragm of the loudspeaker 30, the body 31 comprises a diverging duct 32. The duct 32 guides the air pushed out or sucked in by the diaphragm of the loudspeaker as a substantially one-dimensional flow, with the speed of the air varying relative to the displacement speed of the diaphragm in inverse ratio to the varying sections on going further from the diaphragm. Correspondingly, pressure increases at the outlet section in correspondence with the decrease in speed. A fraction of the kinetic energy of the air is thus recovered by being transformed into pressure, and the turbulence that generally arises at the edge of the diaphragm when the diaphragm radiates into air is avoided.

Theoretically, it might be envisaged to make the outlet sections of the duct 32 so great that the outlet speed of the air is zero and is fully converted into pressure. In practice, outlet sections are used of the order of at least 50% of the surface area of the diaphragm, with which gains of several decibels have been measured at low frequencies.

At its other end, the body 31 comprises a duct 33 of the converging/diverging type.

The duct 33 also performs a function of guiding the flow of air generated by the other face of the diaphragm when the diaphragm moves.

The converging/diverging shape with an intermediate constriction 34 serves to create an inside volume defined at one end by the diaphragm of the loudspeaker 30 and at its other end by the constriction 34 that separates the converging portion from the diverging portion of the duct 33. This volume thus co-operates with the constriction 34 to constitute a Helmholtz resonator.

Two modes of operation can then be distinguished. When sound is emitted at a frequency higher than the characteristic frequency of the resulting resonator, the resonator acts as a wave generator and inverses the phase of the wave which is radiated at the outlet from the duct 33 so that the wave radiated from the outlet of the duct 33 is in-phase with the wave radiated at the outlet from the duct 32. Compared with an enclosure of conventional shape, it has been found that the elongate inside shape of the body can achieve a gain of more than 7 decibels.

When the emitted sound frequency is lower than the characteristic frequency of the resonator, the duct 33 acts as a guide for guiding the flow of air. The pressure wave is then not created by the resonator, but by the alternating displacement of the air present in the duct so as to create convective radiation in the ambient air. In order to limit turbulence at the terminal portion 35 of the duct 33, it is preferably given the shape of a diffuser or nozzle, i.e. a profile of section that presents a concave side facing towards the inside of the duct. Similarly, the edge of the terminal portion of the duct 33 should be rounded in order to avoid any turbulence giving rise to noise when air flows inwards.

The phase of the resulting pressure wave is no longer inverted, such that the wave leaving the duct 33 is in phase opposition with the wave leaving the duct 32. It might be thought that the two waves would then cancel. However, compared with a wave created by a diaphragm radiating into ambient air, it has been found that the wave generated at the outlet of the duct 33 is spectacularly more powerful by several decibels. It therefore matters little whether the two output waves are in phase opposition since the difference in their sound levels prevents one from canceling the other.

Figure 7:
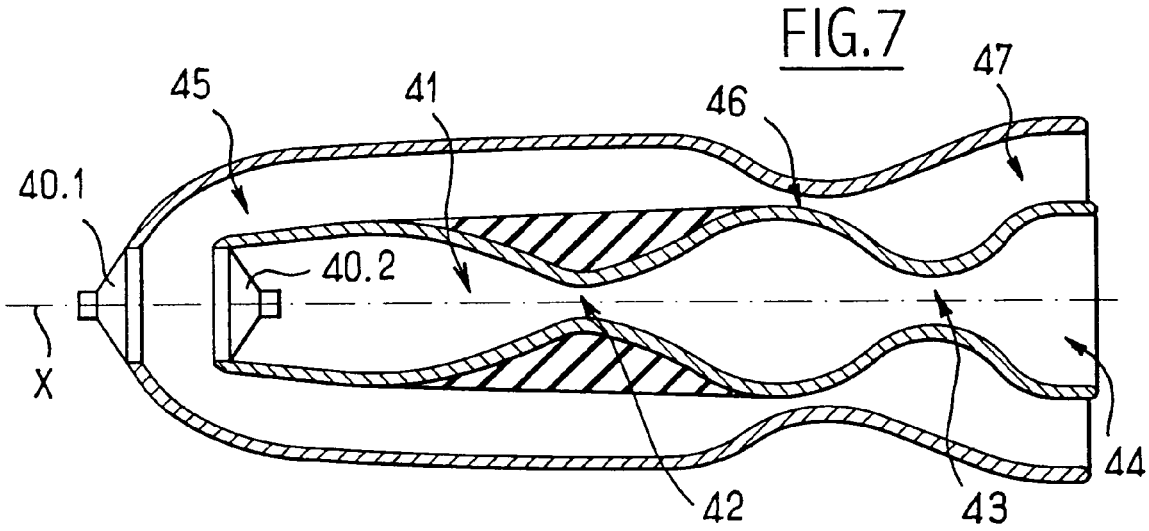
FIG. 7 is an axial section view of a sound emitter of the invention.

In a second embodiment shown in FIG. 7, this sound emitter has an exciter constituted by two loudspeakers 40.1 and 40.2 mounted so that their diaphragms are facing each other, the loudspeakers preferably being electrically connected in phase opposition so that the diaphragms move alternately away from each other and towards each other.

The sound emitter has a first duct 41 of axially symmetrical shape extending about an axis X that is normal to the diaphragms and into which the rear face of the diaphragm of the loudspeaker 40.2 radiates, this duct presenting two successive constrictions 42 and 43 and a diverging outlet 44. The portion of the duct situated between the constrictions 42 and 43 forms a plenum chamber like the chamber 15 fitted to the vent of the invention.

The sound emitter also has a second duct 45 of annular shape extending around the first duct 41 and into which the facing faces of the two diaphragms radiate. The duct 45 has a constriction 46 and a diverging outlet 47.

The rear face of the diaphragm of the loudspeaker 40.1 radiates into the air, but the power that it radiates is negligible compared with the power radiated via the ducts 41 and 45.

While operating at medium and high frequency, the duct 41 forms a dual Helmholtz resonator, while the duct 45 forms a single Helmholtz resonator. Because of their excitation in phase opposition, the pressure waves leaving the ducts 41 and 45 are in-phase.

When operating at low frequency, below the characteristic frequencies of the resonators formed in this way, two macroscopic flows of air are created which generate pressure waves at the outlets of the diverging portions 44 and 47. These pressure waves are in phase opposition, but it appears that one of the flows, specifically the flow in the duct 45, has a much greater effect than the other so the wave leaving the duct 45 is preponderant. The air contained in the other flow has more of a negative feedback effect, which regulates the movements of the two diaphragms.

It has thus been found that the level of power that can be transmitted before the loudspeakers saturate (i.e. before the moving members of the loudspeakers come into mechanical abutment) is raised significantly compared with operation in free air. Furthermore, the gain of the emitter is significantly improved compared with a conventional emitter, and is spectacularly improved at low frequencies.

Figure 8:
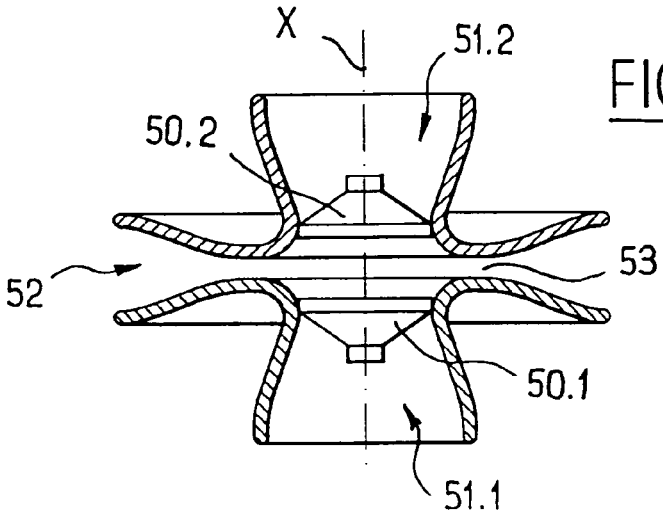
FIG. 8 is an axial section view of a sound emitter of the invention.

In a third embodiment shown in FIG. 8, the sound emitter has two loudspeakers 50.1 and 50.2 mounted in a manner similar to the loudspeakers 40.1 and 40.2 of the preceding embodiment. The faces of the diaphragms that radiate outwards are associated with respective diverging ducts 51.1 and 51.2 forming diffusers that extend along an axis X that is normal to the diaphragms, while the faces of the diaphragms that face each other are associated with a duct 52 of the converging/diverging type that is remarkable in that it is circularly symmetrical about the axis X. The duct 52 thus possesses an annular constriction 53 forming the orifice of a Helmholtz resonator.

In the embodiments shown with reference to FIGS. 6 to 8, care is preferably taken to ensure that the flow is laminar at least in the outlet section of the duct, with this continuing to apply at large amplitudes of diaphragm displacement. For this purpose, a diameter for the outlet section is selected that is quite large, so as to obtain this laminar flow.

Figure 9:
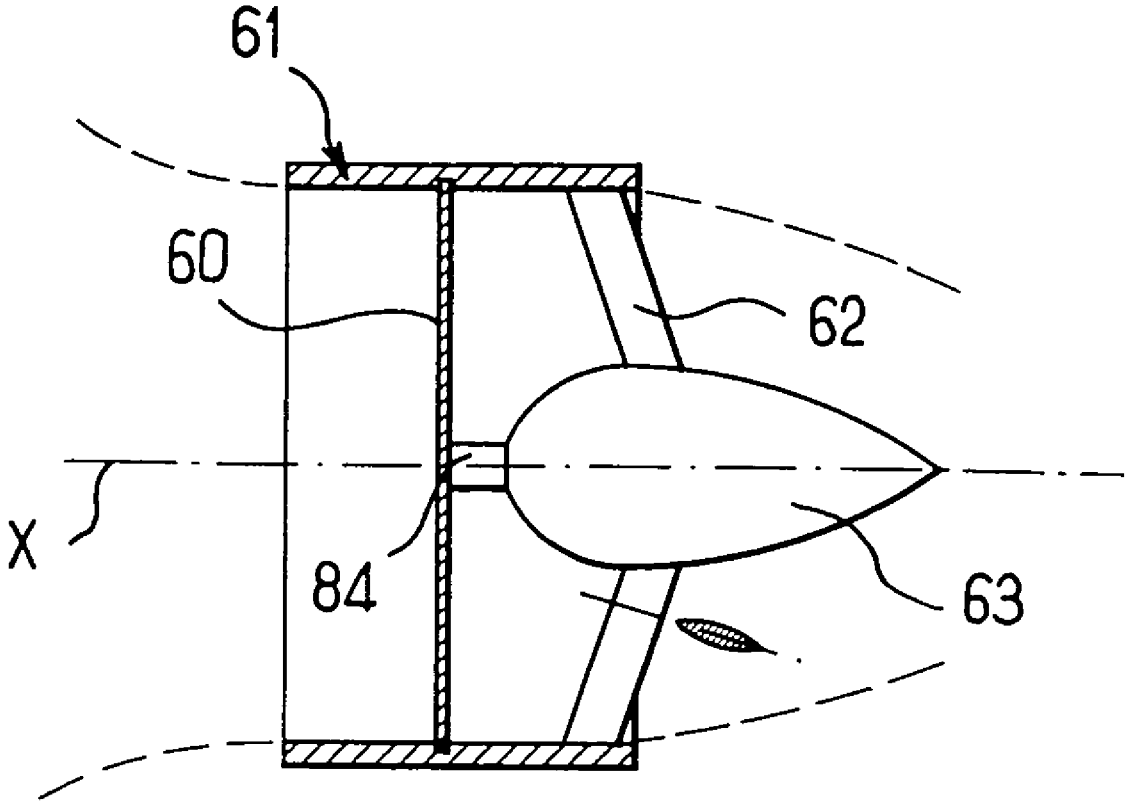
FIG. 9 is an axial section view of a loudspeaker of the invention.

Finally, with reference to FIG. 9, the invention provides a loudspeaker which comprises a diaphragm 60 mounted on a support 61 of tubular shape with an inside wall that is smooth, the support having arms 62 for holding a motor installed in an elongate pod 63. The motor possesses a drive member 64 co-operating with the diaphragm to impart alternating displacements thereto, is thereby leading to macroscopic displacement of the air situated on either side of the diaphragm. Thus, as shown in dashed lines in FIG. 3, the inside face is designed to be connected to an elongate body for channeling the air flow that is produced in this way. The streamlined shapes of the arms 62 and of the pod 63 are selected so as to minimize turbulence in the air flow in which they are immersed.

In a variant that is not shown, the motor could be subdivided into two portions installed on opposite sides of the diaphragm in respective elongate pods.

The invention is not limited to the particular embodiments described above, but on the contrary covers any variant which uses equivalent means to come within the ambit of the invention as defined by the claims.

Although the exciter of the sound emitter is shown as being constituted by the diaphragm of a loudspeaker, the invention can be applied more generally to any exciter capable of generating macroscopic displacement of air, such as a piston moving in a cylinder.

Although the turbulence-attenuating means have been described as being essentially constituted by aerodynamic internal shapes leading to a flow that is regular, any device serving to enable the boundary layer to become re-attached, such as a flap or a peripheral suction device, or indeed a turbulence-damping device, such as a pulsating wall, can form attenuation means of the invention. Finally, the invention covers any means for adapting the shape of the duct or the vent as a function of the operating conditions of the sound emitter (power, frequency), and/or ambient conditions (temperature, background noise, . . . ).

What is claimed is:

1. A sound emitter comprising:

at least one vibrating diaphragm mounted in the wall of an enclosure (2) so that one face of the diaphragm radiates into the enclosure (2), the enclosure (2) being provided with a vent (3; 13; 23) forming a duct (5; 15) between an opening (4; 14) inside the enclosure and an opening (6; 16) outside the enclosure, wherein at least one of the openings (4; 14, 6; 16) is flared in shape towards its end, said flared opening (4; 14, 6; 16) having an end portion presenting a profile of concave section with its concave side facing towards the inside of the opening.

2. A sound emitter according to claim 1, wherein the emitter is being fitted with a plenum chamber (15) between the inside and outside openings (14 and 16).

3. A sound emitter according to claim 2, wherein the plenum chamber (15) forms an angled bend between the inside opening (14) and the outside opening (16).

4. A sound emitter according to claim 1, wherein the outside opening (6; 16) is an outlet section that is equal or greater than half the surface area of the vibrating diaphragm.

5. A sound emitter according to claim 1, wherein at least one of the openings (4, 6; 14, 16) is of a diameter adapted to make the flow of air laminar at the opening (4, 6, 14; 16).

6. A sound emitter comprising:

at least one vibrating diaphragm mounted in a body, the body having a duct (32; 33; 41; 45; 51.1; 51.2; 52) in communication with the outside via a terminal portion (35; 44; 47) and into which one face of the diaphragm radiates, wherein the terminal portion (35; 44; 47) is flared in shape and has an end portion presenting a profile of concave section with its concave side facing towards the inside of the duct.

7. A sound emitter according to claim 6, wherein, the emitter has two loudspeakers (40.1, 40.2; 50.1, 50.2), each loudspeaker having a diaphragm and mounted together in the body so that the diaphragms face each other and are electrically connected in phase opposition with each other, the facing faces of the diaphragms radiating into the internal duct (45; 52).

8. A sound emitter according to claim 7, wherein the internal duct (45; 52) includes a constriction (46; 53).

9. A sound emitter according to claim 7, wherein the duct (52) is of circularly-symmetrical shape about an axis normal to the diaphragm.

10. A method of using a sound emitter comprising at least one vibrating diaphragm mounted in the wall of an enclosure (2) so that one face of the diaphragm radiates into the enclosure (2), the enclosure (2) being provided with a vent (3; 13; 23) forming a duct (5; 15) between an opening (4; 14) inside the enclosure and an opening (6; 16) outside the enclosure, at least one of the openings (4; 14, 6; 16) being flared in shape towards its end, said flared opening (4; 14, 6; 16) having an end portion presenting a profile of concave section with its concave side facing towards the inside of the opening, said sound emitter having a given characteristic Helmholtz frequency, wherein the sound emitter is caused to emit sounds at frequencies below said characteristic Helmholtz frequency.

* * * * *